United States Patent [19]

Oonaka

[11] Patent Number: 4,475,522

[45] Date of Patent: Oct. 9, 1984

[54] FUEL EVAPORATION GAS TREATING DEVICE

[75] Inventor: Hidemi Oonaka, Susono, Japan

[73] Assignee: Toyota Jidosha Kabushiki Kaisha, Aichi, Japan

[21] Appl. No.: 451,426

[22] Filed: Dec. 20, 1982

[51] Int. Cl.[3] ..... F02M 33/02

[52] U.S. Cl. ..... 123/520; 123/519

[58] Field of Search ..... 123/520, 521, 518, 519, 123/DIG. 2

[56] References Cited

U.S. PATENT DOCUMENTS

| | | | |
|---|---|---|---|
| 3,191,587 | 6/1965 | Hall | 123/519 |
| 4,127,097 | 11/1978 | Takimoto | 123/520 |
| 4,318,383 | 3/1982 | Iritani et al. | 123/520 |
| 4,377,142 | 3/1983 | Otsuka et al. | 123/520 |

FOREIGN PATENT DOCUMENTS

| | | | |
|---|---|---|---|
| 32227 | 3/1978 | Japan | 123/520 |
| 129247 | 8/1982 | Japan | 123/519 |

*Primary Examiner*—Magdalen Y. C. Moy

*Attorney, Agent, or Firm*—Parkhurst & Oliff

[57] ABSTRACT

A fuel evaporation gas treating device arranged such that when a vehicle engine is operated a heat-sensitive means detects the temperature around the engine and the fuel system and the like, and if the temperature is within a proper temperature range, a changeover valve allows a carburetor bore and a canister to communicate with each other so that a fuel evaporation gas in the canister is introduced into the carburetor bore and burned through reduction, and on the other hand, when the detected temperature is higher or lower than the optimum value, the changeover valve causes the canister and the carburetor bore to be shut off from each other as well as allows the canister and the atmospheric air vent to communicate with each other so that the secondary air is introduced into the carburetor bore, thereby to make it possible to automatically control the introduction of the evaporation gas and the secondary air into the carburetor bore.

3 Claims, 3 Drawing Figures

FUEL EVAPORATION GAS TREATING DEVICE

BACKGROUND OF THE INVENTION (1) Field of the Invention

The present invention relates to a fuel evaporation gas treating device wherein a passage communicated with a canister port facing a bore of a carburetor provided to an engine mounted on a vehicle is connected with a canister incorporating an activated carbon layer, while another passage from a fuel system is communicated with the activated carbon layer. More particularly, the invention pertains to a fuel evaporation gas treating device arranged such that the first-mentioned passage is provided with a solenoid-operated changeover valve with an atmospheric air vent provided with a filter, and a heat-sensitive means connected with the changeover valve for actuating two kinds of bimetal in order to enable the changeover valve to operate, thereby allowing the changeover valve to selectively connect the canister and the atmospheric air vent with each other.

(2) Description of the Prior Art

It is well known that in an engine mounted on an automobile, as shown in FIG. 1, a fuel 28 stored in a fuel system, e.g., a fuel tank 16 evaporates at all times, and the fuel having evaporated, i.e., what is called evaporation gas, floats in the tank 16, filling the same.

Accordingly, such a device has been generally and widely employed for preventing the evaporation gas from being released into the atmospheric air as a canister 14 incorporating an activated carbon layer 13 adapted to temporarily store the evaporation gas and introduce the same into a carburetor 1, when the engine is operated, for burning the evaporation gas.

However, the evaporation gas differs in the evaporation amount according to the change in the ambient temperature of the engine system and the fuel system of the above-mentioned engine and the like. In consequence, there is also an immeasurable change at all times in the amount of the evaporation gas stored in the canister 4.

Therefore, metering of the fuel in the carburetor 1 is conventionally effected such that the set metering value is fitted for the minimum amount of the gas stored in the canister 4 in order to prevent the air-fuel ratio from becoming overly lean and thereby affecting of the stability the engine operation.

There is, however, a problem when the amount of stored gas increases, wherein a larger amount of the evaporation gas is introduced into the carburetor 1, bringing the carburetor 1 into a rich state. Thus, during hot engine operation when the air-fuel mixture is rich, the engine system may become unstable.

Moreover, there is a disadvantage in the cold operation of an engine wherein the introduction of the evaporation gas may cause deterioration of the exhaust emission control.

SUMMARY OF THE INVENTION

It is, therefore, an object of the present invention to provide an excellent fuel evaporation gas treating device arranged such that the passage connected between the canister and the carburetor bore is provided with a changeover valve with an atmospheric air vent for controlling the supply of the evaporation gas introduced into the carburetor as well as allowing the secondary air to be properly sucked in, thereby solving the above-mentioned problems of the fuel evaporation gas treatment by the canister in accordance with the prior art.

DESCRIPTION OF THE PREFERRED EMBODIMENTS

Figure 2:
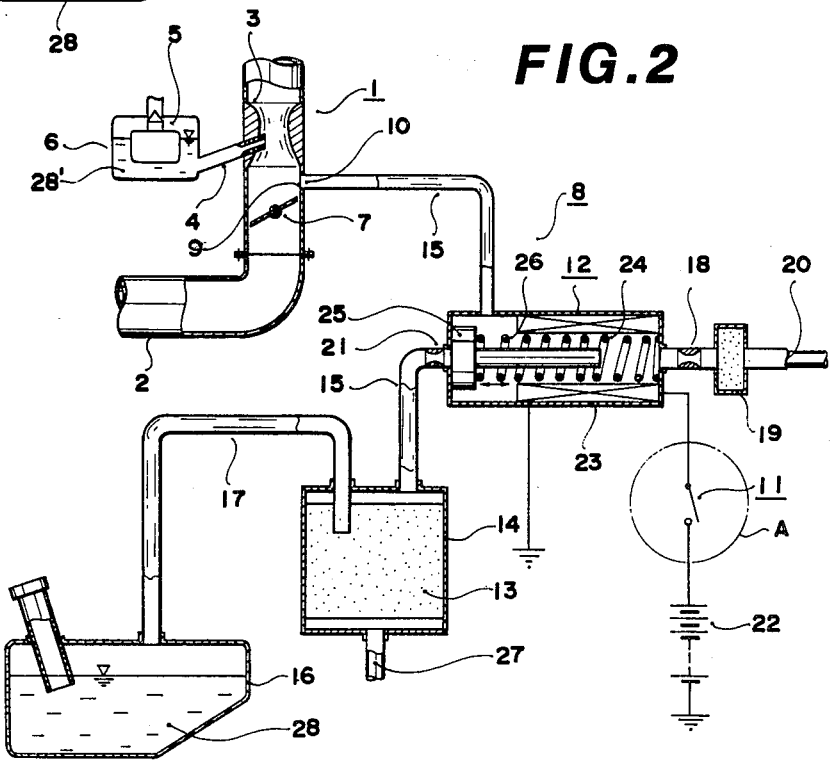
FIG. 2 schematically illustrates a fuel evaporation gas treating device in accordance with a preferred embodiment of the invention.

In FIG. 2, a carburetor 1 is connected through an intake manifold 2 to an engine mounted on an automobile, not shown. A main nozzle 4 facing to a Venturi part 3 is connected with a float chamber 6 having a float 5. Moreover, a throttle valve 7 is provided as usual below the Venturi part 3.

A fuel evaporation gas treating device 8, which constitutes the subject matter of the invention, has a canister port 10 disposed between the Venturi part 3 and the throttle valve 7 of the carburetor 1 and facing to a carburetor bore 9. The canister port 10 is communicated, through a passage 15, with a canister 14 incorporating an activated carbon layer 13, through a changeover valve 12 connected with a heat-sensitive means 11. The activated carbon layer 13 is connected with another passage 17 provided to a fuel tank 16 as a fuel system.

It is to be noted that the canister port 10 is faced to the throttle valve 7 so as to be on the upstream side thereof when the throttle valve 7 is closed and receive a vacuum when it is open.

The rear part of changeover valve 12 is connected with an atmospheric air vent 20 having a throttle 18 and fitted with an air filter 19. The front part of the changeover valve 12 is connected with one part of the passage 15 connected to the canister port 10 and the other part of the passage 15, having a throttle 21, connected to the canister 14. Moreover, a solenoid valve 26 fitted with a pressure spring 24 and having a flange 25 is received by a solenoid coil 23 connected with a power source 22 through the heat-sensitive means 11, thereby allowing the the canister port 10 to be selectively communicated with the atmospheric air vent 20 and the canister 14.

On the other hand, the canister 14 is provided with an atmospheric air vent 27 opposing to the passages 15, 17. In addition, reference numerals 28, 28' denote fuel respectively.

Figure 1:
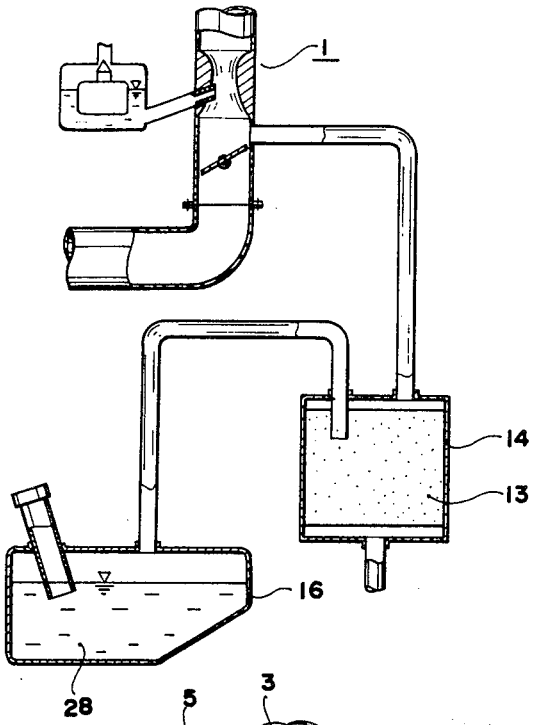
PRIOR ART FIG.1
FIG. 1 schematically illustrates a fuel evaporation gas treating device in accordance with the prior art.
Figure 3:
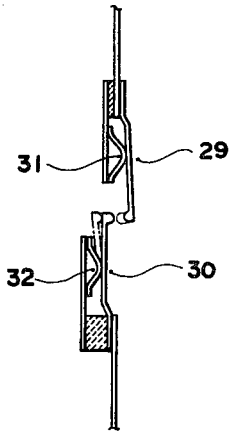
FIG. 3 is an enlarged view of a part A of the fuel evaporation gas treating device shown in FIG. 2.

Moreover, the heat-sensitive means 11 is arranged such that, as shown in FIG. 3, there are provided connecting terminals 29, 30 for connecting the solenoid coil 23 and the power source 22 with each other, and a heat-bending bimetal 31 is brought into contact with one connecting terminal 29, while the other connecting terminal is pushed by a cold heat-contracting bimetal 32 so that the connecting terminals 29, 30 can be short-circuited with each other but are separated from each other when the temperature is not within a set temperature range.

In the arrangement described above, when the engine, not shown, is operated and the throttle valve 7 is opened, the fuel 28' in the float chamber 6 is jetted from the main nozzle 4 into the Venturi part 3 by means of the intake vacuum of the engine, thereby allowing the automobile to be driven.

Meantime, when the ambient temperature of the engine and the fuel tank and the like are within the set temperature range of the heat-sensitive means 11, the connecting terminals 29, 30 are connected with each other. In consequence, the solenoid coil 23 of the changeover valve 12 is energized to cause the solenoid valve 26 to axially slide back against the pressure spring 24, so that the passage 15 on the side of the canister 14 is opened. When the solenoid valve 26 reaches the stroke end thereof, the flange 25 thereof contacts with the solenoid coil 23, shutting off the atmospheric air vent 20.

Thereupon, by the vacuum from the carburetor bore 9, the secondary air from the atmospheric air vent 27 of the canister 14 is passed through the activated carbon layer 13 having previously adsorbed the evaporation gas from the fuel tank 16 and is made to flow in the carburetor bore 9, being controlled by the throttle 21 of the passage 15. Therefore, the evaporation gas also rises, accompanying the same.

Accordingly, the evaporation gas is introduced into the engine and burned through reduction. On the other hand, in a hot operation state, since the engine and the fuel tank 16 and the like are heated higher than the set temperature, the heat-bending bimetal 31 of the heat-sensitive means 11 expands, pressing the connecting terminal 29 to separate from the connecting terminal 30. Therefore, no current is supplied to the solenoid coil 23.

As a result, the solenoid valve 26 allows the atmospheric air vent 20 and the canister port 10 to communicate with each other while being projected by the pressure spring 24 so as to shut off the passage 15 on the side of the canister 14. Thereby, the secondary air from the atmospheric air vent 20 is passed through the air filter 19 and made to flow into the carburetor bore 9, being controlled by the throttle 18.

Accordingly, the evaporation gas adsorbed by the activated carbon layer 13 and having increased in amount owing to the rise in temperature is not sucked into the carburetor bore 9. Moreover, the air-fuel mixture being rich owing to the rise in temperature is properly metered so as to be optimum by the introduction of the secondary air.

On the other hand, when the heat-sensitive means 11 detects a temperature lower than the set temperature, the cold heat-contracting bimetal 32 retreats, causing the connecting terminal 30 to separate from the connecting terminal 29. In consequence, the supply of the current to the solenoid coil 23 is shut off, and the passage 15 on the side of the canister 14 is blocked similarly to the above. Thereby, the secondary air from the atmospheric air vent 20 is introduced into the carburetor bore 9 in order to prevent deterioration of the exhaust emission control.

After the engine returns to a hot operation state, the solenoid valve 26 permits the canister 14 and the canister port 10 to communicate with each other, thereby allowing the evaporation gas to be burned through reduction.

It is a matter of course that the form embodying the invention is not limited to the embodiment described above and a variety of forms may be employed. For instance, the fuel system may be the float chamber or the like other than the fuel tank, and the changeover valve may be a self-operating valve employing a bimetal coil, and moreover, the heat-sensitive means may be adapted to detect the water temperature or the oil temperature besides the ambient temperature.

As will be fully understood from the foregoing description, the invention provides the following excellent effects. In other words, according to the invention, the fuel evaporation gas treating device is arranged such that the passage communicated with the canister port facing the carburetor bore is provided with the changeover valve connected with the heat-sensitive means and having the atmospheric air vent, and is connected with the canister having another passage from the fuel system. Thereby, in the state of extremes of temperature, such as the hot engine operation, the cold engine operation, etc, the heat-sensitive means operates so as to make the changeover valve shut off the canister from the canister port as well as the atmospheric air vent communicate with the canister port. Therefore, the evaporation gas is not introduced into the carburetor bore, but the secondary air is sucked therein instead. Accordingly, the air-fuel mixture is optimumly metered, so that the air-fuel mixture is prevented from being rich in the hot engine operation or the like, while deterioration of the exhaust emission control is prevented in the cold engine operation or the like. Accordingly, it is possible to effect the operation of the engine system constantly with an optimum air-fuel ratio independent of the operation states.

What is claimed:

1. A device for treating evaporated fuel for a combustion engine, comprising:

a first passageway through which evaporated fuel flows from a fuel tank into a carburetor;

a second passageway through which atmospheric air flows into the carburetor;

a canister fluidly connected with said first passageway comprising material for adsorbing evaporated fuel from the fuel tank; and a change-over valve fluidly connected with said first and second passageways, said valve being closed to block the flow of evaporated fuel through said first passageway when the temperature of the engine is above and below predetermined high and low temperatures, respectively, and being open to permit the flow of evaporated fuel and air through said first and second passageways when the engine temperature is between said predetermined high and low temperatures.

2. A device as claimed in claim 1, wherein said change-over valve further comprises a solenoid valve.

3. A device as claimed in claim 1, wherein said change-over valve is a self-operating valve connected with a heat sensitive means.

* * * * *